US008460514B2

(12) United States Patent
Ragvald et al.

(10) Patent No.: US 8,460,514 B2
(45) Date of Patent: Jun. 11, 2013

(54) PAPERMAKING FABRIC

(75) Inventors: Hans Ragvald, Vingåker (SE); Kjell Anders Karlsson, Örebro (SE); Anders Bertilsson, Högsjo (SE); Pia Dela Nord, Högsjo (SE)

(73) Assignee: Voith Patent GmbH, Heidenheim (DE)

( * ) Notice: Subject to any disclaimer, the term of this patent is extended or adjusted under 35 U.S.C. 154(b) by 542 days.

(21) Appl. No.: 12/699,490

(22) Filed: Feb. 3, 2010

(65) Prior Publication Data

US 2010/0155008 A1 Jun. 24, 2010

Related U.S. Application Data

(63) Continuation of application No. PCT/EP2008/055156, filed on Apr. 28, 2008.

(30) Foreign Application Priority Data

Aug. 3, 2007 (DE) ..... 10 2007 036 808

(51) Int. Cl.
*D21F 7/08* (2006.01)
*B32B 27/04* (2006.01)
*B32B 27/40* (2006.01)

(52) U.S. Cl.
USPC ..... 162/358.2; 162/900; 442/164; 442/275

(58) Field of Classification Search
USPC ..... 162/348, 116, 358.2, 358.4, 900–904, 162/306; 442/275, 277, 281, 164; 34/95; 427/285, 288, 389.9, 394; 428/196, 195.1
See application file for complete search history.

(56) References Cited

U.S. PATENT DOCUMENTS

| | | | | |
|---|---|---|---|---|
| 7,267,745 | B2 * | 9/2007 | Crook, Jr. | 162/358.2 |
| 7,306,704 | B2 * | 12/2007 | Hyvonen | 162/358.2 |
| 2006/0130992 | A1 * | 6/2006 | Ouchi et al. | 162/358.1 |
| 2007/0003760 | A1 | 1/2007 | Crook | |

FOREIGN PATENT DOCUMENTS

WO WO 2004/085727 * 10/2004

* cited by examiner

*Primary Examiner* — Eric Hug
(74) *Attorney, Agent, or Firm* — Taylor IP, P.C.

(57) ABSTRACT

The present invention relates to an industrial fabric, in particular press fabric or transfer belt, for use in a papermaking machine. The industrial fabric includes a porous composite structure, having a batt fiber structure and particulate polymeric material. The batt fiber structure has an upper surface and a lower surface extending parallel to the upper surface and spaced from the upper surface along a thickness direction extending perpendicular to the upper and lower surface. The particulate polymeric material is partly fused together and bonded with fibers extending on at least one of the surfaces of the batt fiber structure and with fibers inside the batt fiber structure such that the polymeric material partly impregnates fibers of the batt structure and partly fills interstices between fibers of the batt structure to form the porous composite structure. Further in accordance with the present invention, the composite structure has a varying amount of polymeric material in the batt fiber structure along at least a section of the thickness direction of the batt fiber structure. The present invention further provides a method of making same.

29 Claims, 4 Drawing Sheets

PAPERMAKING FABRIC

CROSS REFERENCE TO RELATED APPLICATIONS

This is a continuation of PCT application No. PCT/EP2008/055156, entitled "PAPERMAKING FABRIC", filed Apr. 28, 2008, which is incorporated herein by reference.

BACKGROUND OF THE INVENTION

1. Field of the Invention

The present invention relates to a press fabric or transfer belt for use in the press section of a papermaking machine and to a method of making an industrial fabric according to the present invention.

2. Description of the Related Art

The demands on printability for graphical papers and graphical boards has consistently increased during recent years. The latest generation of press sections has often been designed to eliminate the open draw between the press and the dryer section. This means that the paper web is totally supported by fabrics all through the press section and, therefore, has no contact with smooth plain press rolls. Thus, the demands on press fabrics' surface smoothness and contact area have also consistently increased.

To improve surface smoothness, impermeable belts often are used, directly contacting the paper web. Such impermeable belts have a smooth paper contacting surface but the paper produced on those belts often show a two sidedness. In addition, use of such impermeable belts results in reduced dewatering performance.

Porous press fabrics with polymeric material embedded in the batt structure have been developed to provide both good dewatering capability and improved surface smoothness. Paper sheets produced on such porous fabrics show good printability. However, paper produced on such known fabrics often show hydraulic marking due to improvable drainage characteristics of such porous fabrics.

What is needed in the art is a press fabric or transfer belt with a smooth paper contacting surface and with improved dewatering characteristics, as well as a method of making the same.

SUMMARY OF THE INVENTION

The present invention provides an industrial fabric, in particular a press fabric or a transfer belt for use in a papermaking machine, with a porous composite structure, wherein the composite structure includes a batt fiber structure and particulate polymeric material. The batt fiber structure has an upper surface and a lower surface extending parallel to the upper surface and spaced from the upper surface along a thickness direction extending perpendicular to the upper and lower surface. In the composite structure, the polymeric material is partly fused together and bonded with fibers extending on at least one of the surfaces of the batt fiber structure and with fibers inside the batt fiber structure such that the polymeric material partly impregnates fibers of the batt structure and partly fills interstices between fibers of the batt structure to form the porous composite structure. The industrial fabric according to the present invention is characterized in that the composite structure has a varying amount of polymeric material in the batt fiber structure along at least a section of the thickness direction of the batt fiber structure.

The upper and the lower surface of the batt fiber structure extend in a plane in the cross machine direction (CMD) and machine direction (MD) of the fabric. In other words, the fabric according to the present invention is characterized in that the amount of polymeric material in the batt fiber structure at a first CMD-MD orientated plane is different than the amount of polymeric material in the batt fiber structure at a second CMD-MD orientated plane, wherein the second CMD-MD orientated plane is spaced apart from the first CMD-MD orientated plane in the thickness direction.

Therefore, according to the present invention, an industrial fabric having a composite structure with a variable adjustable amount of polymeric material in the batt fiber structure is provided. The fabric according to the present invention can have at different thickness levels of the composite structure a different amount of polymeric material, thus resulting in an industrial fabric with enhanced dewatering and damping characteristics, since the dewatering and the damping characteristics of the fabric are influenced by the amount of polymeric material in the composite structure. The expression thickness level means a CMD-MD orientated plane of the composite structure, which can either be located on the upper or lower surface, or in between the two surfaces of the batt fiber structure. The varying amount of polymeric material along the section of the thickness direction does not necessarily mean that the amount constantly varies along the section. The amount of polymeric material can also change in one or more steps. The expression amount of polymeric material can, for example, mean the absolute mass of polymeric material in the batt fiber structure at a certain thickness level or the relative mass of polymeric material compared with the total mass of the composite structure at a certain thickness level or the relative volume of polymeric material in the batt fiber structure compared with the total volume of the composite structure at a certain thickness level.

According to a first embodiment of the present invention, the porosity of the composite structure varies along a section of the thickness direction. Therefore, according this embodiment of the present invention, the composite structure may have different porosities at different thickness levels of the composite structure. It is understood that at a thickness level with a high amount of polymeric material, often the porosity of the composite structure is lower compared with a thickness level with a lower amount of polymeric material. Therefore, the composite structure of the industrial fabric may have a varying permeability in the thickness direction, which is the main drainage direction. Accordingly, the fabric has improved drainage characteristics which may be adjusted to the specific operational requirements of the fabric. The thickness of the batt fiber structure is defined by the distance from the upper to the lower surface of the batt fiber layer, measured along a thickness direction.

According to a second embodiment of the present invention, the composite structure extends over the thickness of the batt fiber structure.

According to a third embodiment of the present invention, the composite structure has a varying amount of polymeric material in the batt fiber structure along the entire thickness of the batt fiber structure. In other words, the composite structure extends over the entire thickness of the batt fiber structure and the amount of polymeric material varies over the entire thickness of the batt fiber structure.

To improve the dimensional stability of the fabric of the present invention, the batt fiber structure may be needled to a base cloth. The base cloth can be woven or non-woven or spiral link fabric or a combination thereof. The base cloth extends parallel to the upper and lower surface of the batt fiber structure. Different positions of the base cloth relative to the upper and lower surface of the batt fiber structure are possible.

According to fourth embodiment of the present invention, the base cloth is located between the upper and lower surfaces. Thus, the base cloth is positioned inside the batt fiber structure. According to an alternative embodiment the lower surface of the batt layer structure adjoins the base cloth.

According to a fifth embodiment of the present invention, the distance between the upper and the lower surface defines the total thickness of the batt fiber structure and the amount of polymeric material in the batt fiber structure decreases from the upper surface towards the lower surface. According to this embodiment of the present invention, the porosity of the composite structure can increase from the upper surface, e.g., the paper contacting surface of the fabric, toward the lower surface, e.g., the surface connected to the base cloth or the machine contacting surface, to provide improved drainage characteristics as a result of decreasing dewatering pressure from the paper contacting surface towards the opposing surface.

To influence the amount of polymeric material deposited at a certain thickness level in the batt fiber structure, the batt fiber structure may include fibers of different coarseness, particularly if the batt fiber structure is built up of more than one batt layer, wherein each batt layer is characterized by fibers of a certain coarseness or coarseness range. The fibers of one of the batt layers may be coarser than the fibers of another of the layers. The amount of polymeric material located at a certain thickness level can be influenced by the coarseness of the batt layers and by the order the batt layers of different coarsenesses are stacked relatively to one another. Therefore, according to a sixth embodiment of the present invention, the coarseness of the batt fiber structure may decrease from the upper to the lower surface of the batt fiber structure. This decrease in coarseness can be achieved by stacking batt layers with decreasing coarseness on top of each other, such that the coarsest batt layer is located at the upper surface and the finest or least batt layer is positioned at the lower surface. The fibers of the coarse batt layer may range from approximately 17 to 220 dtex, for example 22 to 67 dtex, and the fibers of the at least one less coarse batt layer may range from approximately 1.7 to 11 dtex.

The amount of polymeric material in a batt layer with coarser fibers may be more than the amount of polymeric material in a batt layer with less coarse fibers. For example, if the batt fiber structure is built up from a coarse batt layer and from a less coarse batt layer underneath the coarse batt layer and if the polymeric material is applied first onto the surface of the coarse batt layer which can be the upper surface of the batt layer structure—such that the polymeric material first penetrates through the coarse layer before penetrating through the less coarse batt layer, the amount of polymeric material in the coarse batt layer may be higher than in the less coarse batt layer, resulting in some cases in a lower porosity of the composite structure at a thickness level at which the composite structure is formed from the coarse batt layer and the polymeric material compared with the porosity of the composite structure at a thickness level at which the composite structure is formed from the less coarse batt layer and the polymeric material.

According to a seventh embodiment of the present invention, the porosity of the composite structure at a thickness level where the composite structure is formed from a batt layer with coarse fibers is lower than at a thickness level where the composite structure is formed from a batt layer with less coarse fibers.

According to an eighth embodiment of the present invention, at the upper surface a coarse batt layer is positioned and at the lower surface, a less coarse batt layer is located.

According to a ninth embodiment of the present invention, the upper surface of the batt fiber structure is provided by a coarse batt layer into which polymeric material is embedded and the lower surface of the batt structure is provided by a less coarse batt layer into which polymeric material is embedded, partly impregnating fibers of the batt structure. According to this embodiment, the batt structure is impregnated with the polymeric material over its entire thickness.

Depending on the specific method of application of the polymeric material, the amount of polymeric material in the coarse batt layer at the upper surface may be greater than in the less coarse layer at the lower surface. This can be achieved if, for example, the polymeric material is applied from the upper surface to the batt fiber structure. The amount of polymeric material in the coarse batt layer at the upper surface may be less than or equal to the amount of polymeric material in the less coarse batt layer at the lower surface. This can be achieved, e.g., if polymeric material is applied from the upper and the lower surface to the batt fiber structure.

According to a tenth embodiment of the present invention, the porosity of the composite structure at a thickness level where the composite structure is formed from a batt layer with coarse fibers is greater than at a thickness level where the composite structure is formed from a batt layer with less coarse fibers.

According to an eleventh embodiment of the present invention, the paper contacting surface of the fabric may be provided by the upper surface of the batt fiber structure and the polymeric material partly impregnating fibers of the batt structure on the upper surface.

According to an alternative embodiment, the paper contacting surface of the fabric may be provided by a polymer layer extending over the composite structure in the thickness direction. In this embodiment the paper contacting surface includes no fibers. According to a further alternative embodiment of the present invention, the paper contacting surface of the fabric is provided by the upper surface of the batt fiber structure. In this embodiment, the paper contacting surface includes no material other than fibers.

The paper contacting surface of the fabric may have a contact area of at least approximately 50%, for example, in the range from approximately 80% to 99.5%.

The fabric according to the present invention, may be permeable to water and air and have an air permeability in the range from approximately 0.008 cfm to 50 cfm.

The polymeric material can include thermoplastic or thermoset polymeric material or a mixture thereof, for example, the polymeric material may include thermoplastic elastomeric polymeric material or thermoplastic elastomeric polyurethane.

The present invention further provides a method of making an industrial fabric including the following steps:

a) providing particulate polymeric material;

b) providing a batt fiber structure with an upper and a lower surface, the upper and lower surface extending parallel to each other and being spaced from each other along a thickness direction perpendicular to the upper and lower surface;

c) applying the particulate polymeric material to at least one of the surfaces of the batt fiber structure;

d) causing the particulate polymeric material to at least partly penetrate into the batt fiber structure in a controlled manner along the thickness direction to adjust the amount of polymeric material along the thickness direction; and e) thermally activating the particulate polymeric material to form a composite structure in which the particulate material is bonded to fibers, such that it partly impregnates fibers of the batt structure and partly fills interstices between the fibers of the batt structure.

The controlled penetration of the particulate polymeric material can be such that the amount of polymeric material in the batt fiber structure varies along at least a section of the thickness direction. The controlled penetration of the particulate polymeric material can also be such that the amount of polymeric material in the batt fiber structure is constant along at least a section of the thickness direction.

The particulate polymeric material may be applied to the batt fiber structure in a number of ways. According to a first embodiment of the method according to the present invention, the particulate polymeric material is applied to the batt fiber structure in the form of at least one dispersion of particulate polymeric material. The particulate polymeric material may penetrate into the batt fiber structure such that the porosity of the composite structure at the upper surface is different than the porosity of the composite structure at the lower surface. In this case, the porosity may, for example, be lower at the upper surface relative to the porosity at the lower surface.

According to a second embodiment of the present invention, the causing step d) is influenced by the coarseness of the fibers in the batt structure and/or the size of the particulate polymeric material. For example, small particles can penetrate through a coarse batt layer without significantly being trapped in the coarse batt layer, wherein large particles can be trapped in the coarse layer. Therefore, if the batt fiber structure includes a coarse batt layer on top of a less coarse batt layer and if fine particles are applied to the batt fiber structure such that they have to penetrate first through the coarse layer, a composite structure is generated with an amount of polymeric material in the less coarse batt layer which is greater than in the amount of polymeric material in the coarse batt layer. On the other hand if large particles are applied to the above mentioned batt fiber structure such that they have to penetrate first through the coarse layer before penetrating into the less coarse batt layer, a composite structure is generated with an amount of polymeric material in the coarse batt layer which is greater than the amount of polymeric material in the less coarse batt layer.

According to a further example, if, in a first step, fine particles are applied to the batt fiber structure such that they have to penetrate first through the coarse layer before penetrating into the less coarse layer, most of them will be trapped in the less coarse batt layer. If, in a second step, coarse particles are applied such that they have to penetrate first through the coarse layer before penetrating through the less coarse layer, most of the coarse particles will be trapped in the coarse layer, resulting in a composite structure with a constant amount of polymeric material along the thickness direction. Alternatively, if the batt fiber structure only includes a homogenous batt, which means a batt layer with a specific fiber coarseness, and particles of different sizes are applied to this batt fiber structure, a composite structure with a varying amount of polymeric material along the thickness direction can be generated.

Further, the causing step d) can be influenced by sucking the particulate polymeric material into the batt fiber structure by the application of a vacuum. The application of a vacuum influences the penetration depth of the polymeric material and the varying amount of polymeric material along the penetration depth extending along the thickness direction. The provide a smooth paper contacting surface with a high contact area, according to a third embodiment of the present invention, the polymeric particulate material may be applied to the batt fiber structure from the upper surface, for example, forming the paper contacting surface of the fabric.

To influence the varying amount of polymeric material along the thickness direction, the at least one dispersion of particulate polymeric material which is applied to the batt fiber structure may include particles of different sizes. Alternatively, or in addition, more than one dispersion of particulate polymeric may be applied to the batt fiber structure, wherein the size of the particles in at least one dispersion is different to the size of the particles in another dispersion. The particulate polymeric material can have a size in the range from approximately 0.01 μm to about 1 mm. By way of example, large particles can have a size in the range from approximately 100-200 μm, wherein smaller particles can have a size in the range from approximately 30-50 μm.

To influence the varying amount of polymeric material along the thickness direction in a controlled manner, the particulate polymeric material may be applied to one of the surfaces and vacuum may be applied to the other of surfaces of the batt fiber structure. For example, the particulate polymeric material may be applied to the upper surface and the vacuum applied to the lower surface of the batt fiber structure.

To further influence the varying amount of particulate polymeric material along the thickness direction, thermal activation may be provided by a heating means facing toward the one surface of the batt fiber structure to which the particulate polymeric material has been applied and/or toward the other surface of the batt fiber structure to which the vacuum has been applied. The varying amount of particulate polymeric material in the batt fiber structure can also be influenced by using particulate polymeric materials with different melting points.

To also partly impregnate the reinforcing base cloth with the polymeric material for improved delaminating resistance of the fabric, the method may further include the step of needling the batt fiber structure to a base cloth before the particulate polymeric material is applied to the batt fiber structure. The particulate polymeric material may also at least partly penetrate into the base cloth.

To provide a smooth paper contacting surface of the fabric, the method may further include, after the application of the dispersion and before the thermal activation of the dispersion, the step of spreading the particulate material on the surface of the batt fiber structure with the assistance of a spreading element, for example, a doctor blade.

According to a fourth embodiment of the present invention, the provided batt layer structure may include more than one batt layer, wherein the fibers of one of the batt layers being coarser than the fibers of another of the layers.

According to a fifth embodiment of the method according to the present invention, the particulate polymeric material is caused to penetrate into the batt fiber structure such that the amount of polymeric material in the batt layer with coarse fibers is more than the amount of polymeric material in the batt layer with less coarse fibers. The particulate polymeric material may be caused to penetrate into the batt fiber structure such that polymeric material with larger particle size is primarily captured in the batt layer with coarse fibers and such that polymeric material with a smaller particle size is primarily captured in the batt layer with less coarse fibers.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
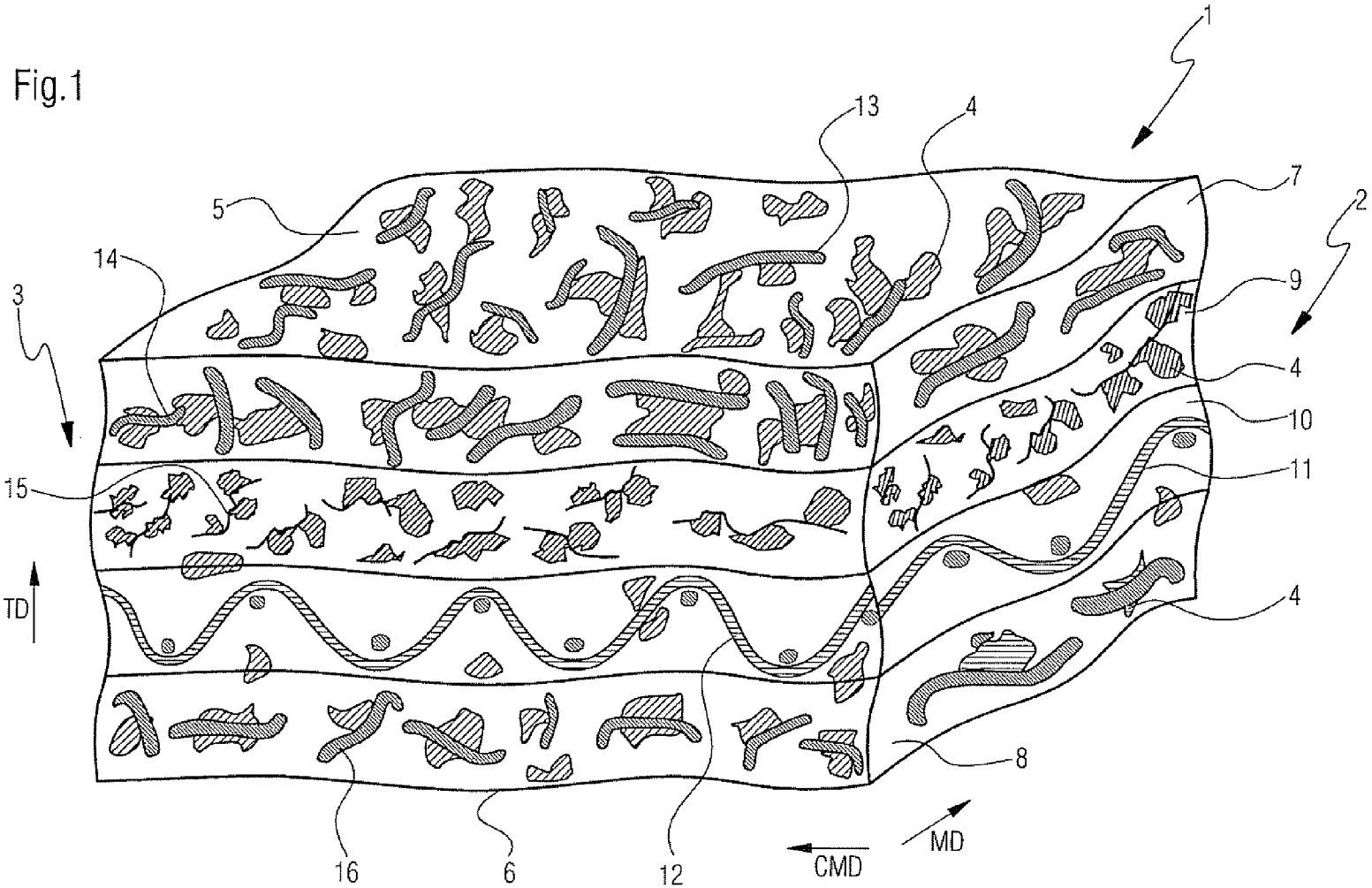
FIG. 1 is a schematic drawing of a first embodiment of a fabric according to the present invention in a perspective view.

Referring now to the drawings, and more particularly to FIG. 1, there is shown press fabric 1 for use in a papermaking machine, with porous composite structure 2. Composite structure 2 includes batt fiber structure 3 and particulate polymeric material 4. Batt fiber structure 3 has upper surface 5 and lower surface 6 extending parallel to upper surface 5 and spaced from upper surface 5 along thickness direction (TD) extending perpendicular to upper surface 5 and lower surface 6.

Batt fiber structure 3 includes upper coarse batt layer 7, lower coarse batt layer 8 and intermediate less coarse batt layer 9. Coarse batt layers 7 and 9 have fibers in the range of approximately 22 to 44 dtex. Intermediate less coarse batt layer 9 includes fibers in the range from approximately 6.7 to 11 dtex. Upper coarse batt layer 7 is stacked on top of intermediate less coarse batt layer 9. Intermediate less coarse batt layer 9 is stacked on top of woven base cloth 10, woven from MD- and CMD orientated yarns 11, 12. Woven base cloth 10 is stacked on top of lower coarse batt layer 8. Therefore, base cloth 10 is located between upper surface 5 and lower surface 6.

Before the application of particulate polymeric material 4, batt fiber structure 2 is needled to base cloth 10. As can be seen, polymeric material 4 is partly fused together and bonded with fibers 13 on upper surface 5 of batt fiber structure 3 and with fibers 14, 15 and 16 inside batt fiber structure 2 such that polymeric material 4 partly impregnates fibers 13, 14, 15 and 16 of batt structure 3 and partly fills interstices between fibers 13, 14, 15 and 16 of batt structure 3 to form porous composite structure 2. Polymeric material 4 also partly impregnates yarn 11, 12 of woven base cloth 10. Polymeric particles 4 applied to batt fiber structure 3 have a particle size of approximately 120 μm. Polymeric material 4 is thermoplastic elastomeric polyurethane. After thermal activation, particulate material 4 is at least partly fused together.

According to the present invention, composite structure 2 has a varying amount of polymeric material 4 in batt fiber structure 3 along thickness direction TD of batt fiber structure 3. At a thickness level of composite structure 2 where upper coarse batt layer 7 is located polymeric material 4 occupies between approximately 85% and 65% of the volume of upper coarse batt layer 7, wherein the rest of the volume is occupied by fibers 13, 14 and void. Further, at a thickness level of composite structure 2 where intermediate less coarse batt layer 9 is located, polymeric material 4 only occupies between approximately 25% and 45% of the volume of intermediate less coarse batt layer 9, wherein the rest of the volume is occupied by fibers 15 and void. At a thickness level of composite structure 2 where lower coarse batt layer 8 is located, polymeric material 4 occupies between approximately 55% and 65% of the volume of lower coarse batt layer 8, wherein the rest of the volume is occupied by fibers 16 and void.

Therefore, the amount of polymeric material 4 in batt layer 7 with coarse fibers 13, 14 is greater than the amount of polymeric material 4 in batt layer 9 with less coarse fibers 15. In the current embodiment, particulate polymeric material 4 has, for example, been applied to batt fiber structure 3 from upper surface 5 and from lower surface 6. The porosity of composite structure 2 varies along thickness direction TD. The porosity increases along thickness direction TD from upper batt layer 7 to intermediate batt layer 9 and decreases from intermediate batt layer 9 to lower batt layer 8. Therefore, the porosity of composite structure 2 at a thickness level where composite structure 2 is formed from batt layer 7 with coarse fibers 13, 14 is lower than at a thickness level where composite structure 2 is formed from batt layer 9 with less coarse fibers 15. In the current embodiment, the paper contacting surface of fabric 1 is provided, for example, by upper surface 5 of batt fiber structure 3, which is partly impregnated with polymeric material 4. The paper contacting surface of press fabric 1 has a contact area of approximately 89%. Press fabric 1 is permeable to water and air and has an air permeability of approximately 1 cfm.

Figure 2:
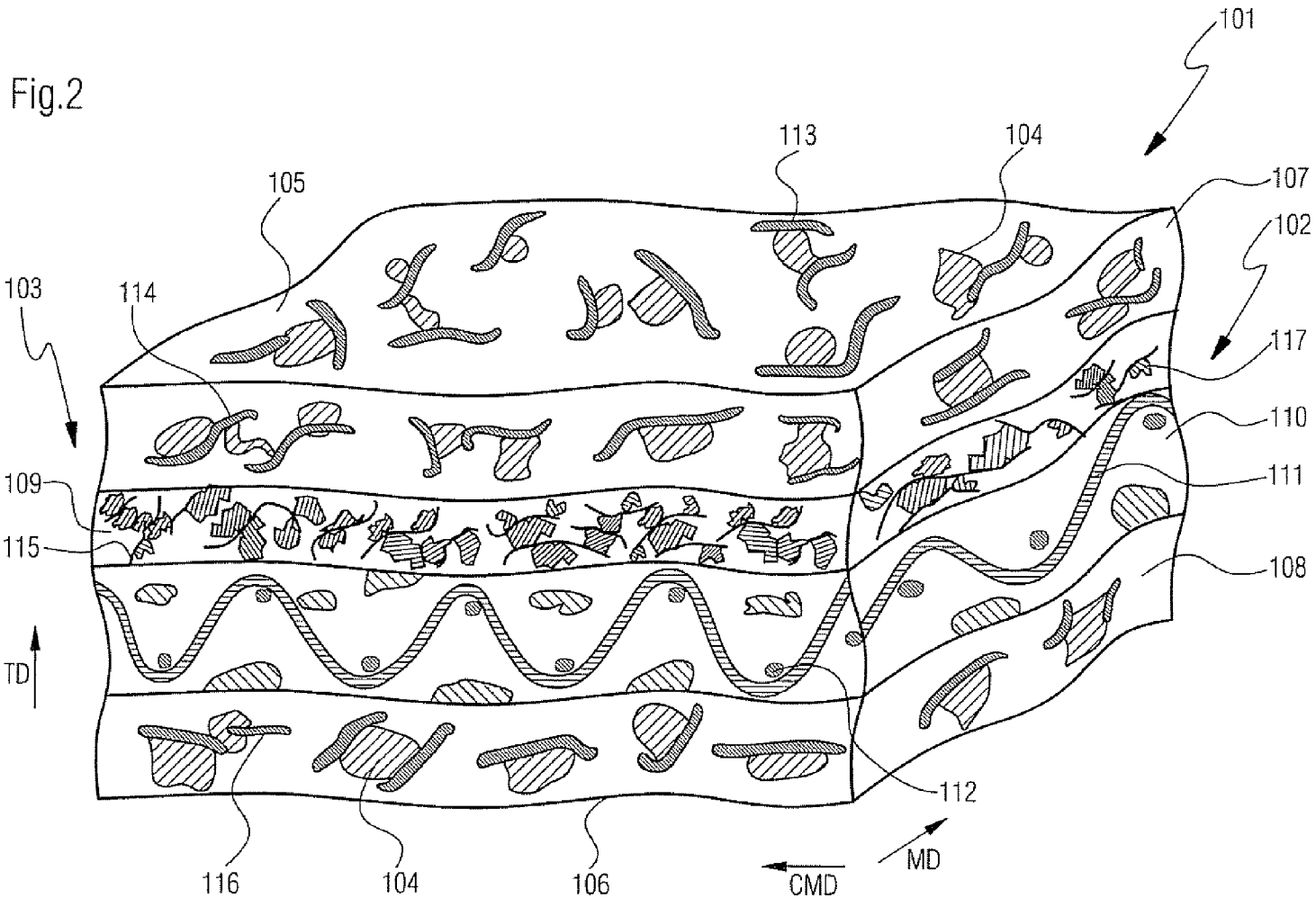
FIG. 2 is a schematic drawing of a second embodiment of a fabric according to the present invention in a perspective view.

Referring now to FIG. 2, there is shown a second embodiment of press fabric 101 according to the present invention for use in a papermaking machine. Fabric 101 has porous composite structure 102. Composite structure 102 includes batt fiber structure 103 and particulate polymeric material 104 and 117. Batt fiber structure 103 has upper surface 105 and lower surface 106 extending parallel to upper surface 105 and spaced from upper surface 105 along thickness direction TD extending perpendicular to upper surface 105 and lower surface 106.

Batt fiber structure 103 includes upper coarse batt layer 107, lower coarse batt layer 108 and intermediate less coarse batt layer 109. Upper coarse batt layer 107 has fibers in the range of approximately 22 to 67 dtex, wherein lower coarse batt layer 108 has fibers in the range of approximately 22 to 44 dtex. Intermediate less coarse batt layer 109 is made from fibers in the range from approximately 3.3 to 11 dtex. Upper coarse batt layer 107 is stacked on top of intermediate less coarse batt layer 109. Intermediate less coarse batt layer 109 is stacked on top of woven base cloth 110, woven from MD- and CMD orientated yarns 111, 112. Woven base cloth 110 is stacked on top of lower coarse batt layer 108. Therefore, base cloth 110 is between upper surface 105 and lower surface 106. Before the application of particulate polymeric material 104 and 117, batt fiber structure 102 is needled to base cloth 110.

Polymeric particles 104, 117 applied to batt fiber structure 103 have different particle sizes. Small polymeric particles 117 have a particle size, for example, from approximately 30 to 50 μm, wherein large particles 104 have a particle size from approximately 100 to 150 μm. As previously discussed, small particles can penetrate through a coarse batt layer without being trapped in the coarse batt layer, wherein large particles can be trapped in the coarse layer. During manufacture of fabric 101, in a first step, small particles 117 are applied to upper surface 5 of batt fiber structure 3 such that small particles 117 penetrate first through upper coarse layer 107 before penetrating through intermediate less coarse layer 109. Therefore, most of small particles 117 are trapped in less coarse batt layer 109. In a second step, large particles 104 were applied such that they penetrate first through upper coarse layer 107 before penetrating through intermediate less coarse layer 109. Therefore, most of large particles 104 are trapped in upper coarse layer 107.

Polymeric material 104 and 117 is, for example, thermoplastic elastomeric polyurethane. After the application of particulate polymeric material 104, 117, polymeric material 104, 117 and batt fiber structure 103 are thermally activated. After thermal activation, particulate material 104 and 117 are at least partly fused together.

Polymeric material 104 is partly fused together and bonded with fibers 113 on upper surfaces 105 of batt fiber structure 103 and with fibers 114 and 116 inside batt fiber structure 102. Further, polymeric material 117 is partly fused together and bonded with fibers 115 inside batt fiber structure 102. Polymeric material 104 and 117 partly impregnate fibers 113, 114, 115 and 116 of batt structure 103 and partly fill interstices between fibers 113, 114, 115 and 116 of batt structure 103 to form porous composite structure 102.

According to the present invention, composite structure 102 has a varying amount of polymeric material 104, 117 in batt fiber structure 103 along thickness direction TD of batt fiber structure 103. At a thickness level of composite structure 102 where upper coarse batt layer 107 is located, polymeric material 104 occupies between approximately 55% and 65% of the volume of upper coarse batt layer 107, wherein the rest of the volume is occupied by fibers 113, 114 and void. At a thickness level of composite structure 102 where intermediate less coarse batt layer 109 is located, polymeric material 117 occupies approximately 40% of the volume of intermediate less coarse batt layer 109, wherein the rest of the volume is occupied by fibers 115 and void. At a thickness level of composite structure 102 where lower coarse batt layer 108 is located, polymeric material 104 occupies between approximately 55% and 65% of the volume of lower coarse batt layer 108, wherein the rest of the volume is occupied by fibers 116 and void.

Therefore, the amount of polymeric material 104, 107 in batt layer 107 with coarse fibers 113, 114 is less than the amount of polymeric material 117 in batt layer 109 with less coarse fibers 115.

Particulate polymeric material 104 is applied to batt fiber structure 103 from upper surface 105 and from lower surface 106. Particulate polymeric material 117 only has been applied to the batt fiber structure 103 from upper surface 105.

The porosity of composite structure 102 varies along thickness direction TD. The porosity decreases along thickness direction TD from upper batt layer 107 to intermediate batt layer 109 and increases from intermediate batt layer 109 to lower batt layer 108. Therefore, the porosity of composite structure 102 at a thickness level where composite structure 102 is formed from batt layer 107 with coarse fibers 113, 114 is higher than at a thickness level where composite structure 102 is formed from batt layer 109 with less coarse fibers 115. The paper contacting surface of fabric 101 is provided by upper surface 105 of batt fiber structure 103, which is partly impregnated with polymeric material 104. Polymeric material 104, 117 also partly impregnates yarn 111, 112 of woven base cloth 110. The paper contacting surface of press fabric 101 has a contact area of, for example, 53%. Press fabric 1 is permeable to water and has air and an air permeability of, approximately 45 cfm.

Figure 3:
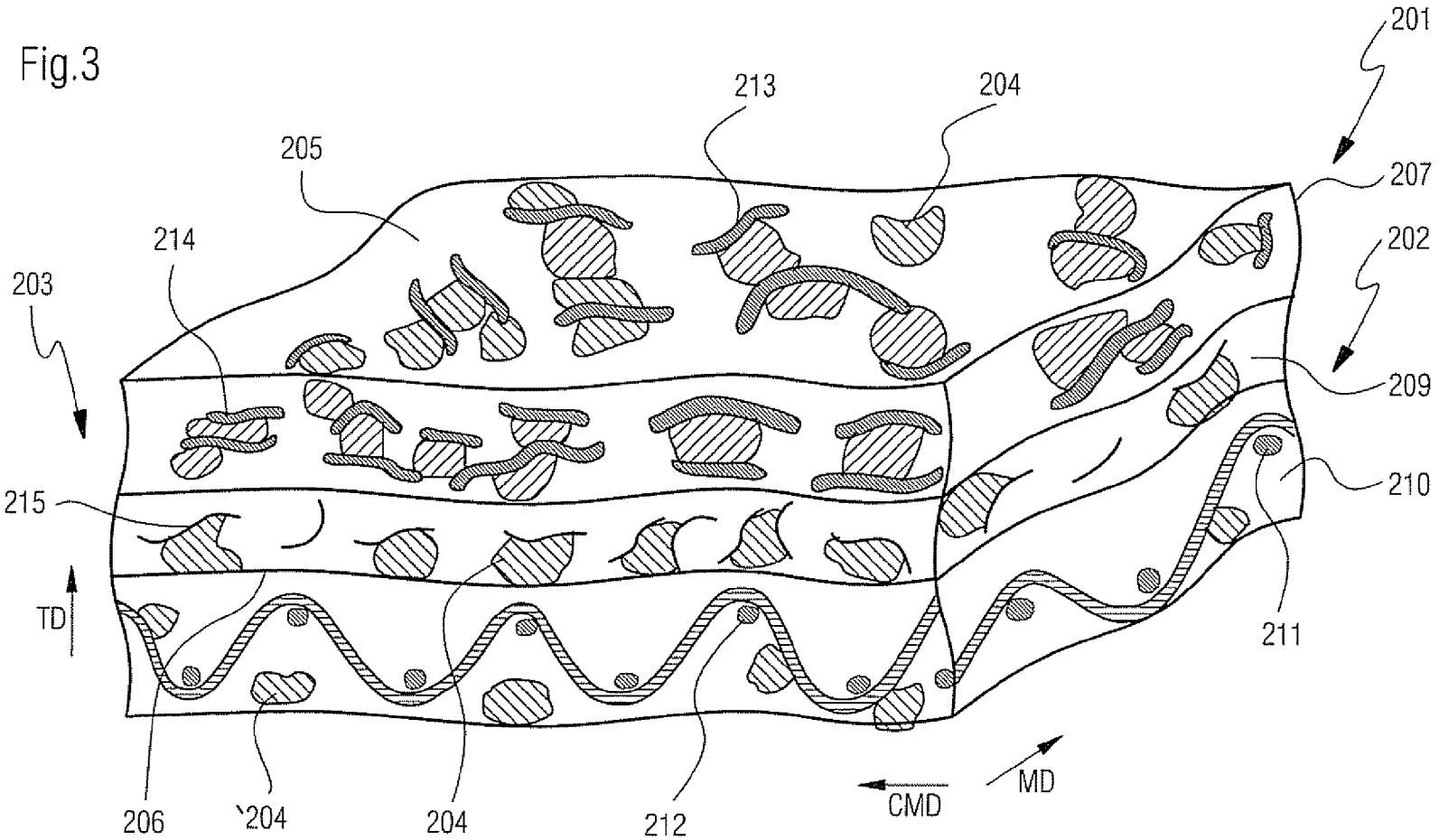
FIG. 3 is a schematic drawing of a third embodiment of a fabric according to the present invention in a perspective view.

Referring now to FIG. 3 there is shown a third embodiment of press fabric 201 according to the present invention for use in a papermaking machine. Fabric 201 has porous composite structure 202. Composite structure 202 includes batt fiber structure 203 and particulate polymeric material 204. Batt fiber structure 203 has upper surface 205 and lower surface 206 extending parallel to upper surface 205 and spaced from upper surface 205 along thickness direction TD extending perpendicular to upper surface 205 and lower surface 206.

Batt fiber structure 203 includes upper coarse batt layer 207 and lower less coarse batt layer 209. Upper coarse batt layer 207 has fibers in the range of approximately 22 to 44 dtex, wherein lower less coarse batt layer 209 has fibers in the range of approximately 11 to 22 dtex. Upper coarse batt layer 207 is stacked on top of lower less coarse batt layer 209. Less coarse batt layer 209 is stacked on top of woven base cloth 210, woven from MD and CMD orientated yarns 211, 212. Therefore, lower surface 206 of batt fiber structure 203 adjoins base cloth 210. Before the application of particulate polymeric material 204, batt fiber structure 202 is needled to base cloth 210. Polymeric particles 204 applied to batt fiber structure 103 have, for example, uniform particle size in the range from approximately 120 to 150 μm.

As previously discussed, large particles are mostly trapped when penetrating through a coarse batt layer. During manufacture of fabric 201, only large particles 204 are applied to upper surface 205 of batt fiber structure 103 such that large particles 204 penetrate first through upper coarse layer 207 before penetrating through lower less coarse layer 209. Therefore, more of large particles 204 are trapped in upper coarse batt layer 207.

Therefore, according to the present invention, composite structure 202 has a varying amount of polymeric material 204 in batt fiber structure 203 along thickness direction TD of batt fiber structure 203. At a thickness level of composite structure 202 where upper coarse batt layer 207 is located, polymeric material 204 occupies between approximately 70% and 75% of the volume of upper coarse batt layer 207, wherein the rest of the volume is occupied by fibers 213, 214 and void. Further, at a thickness level of composite structure 202 where lower less coarse batt layer 209 is located, polymeric material 204 occupies approximately 50% of the volume of lower less coarse batt layer 209, wherein the rest of the volume is occupied by fibers 215 and void.

Therefore, batt fiber structure 203 includes coarse batt layer 207 on top of less coarse batt layer 209 wherein large particles 204 are applied to batt fiber structure 203 such that they penetrated first through coarse layer 207 before penetrating into lower less coarse batt layer 209. Composite structure 202 is generated with an amount of polymeric material 204 in lower less coarse batt layer 209 which is less than the amount of polymeric material 204 in upper coarse batt layer 207. Polymeric material 204 is, for example, thermoplastic elastomeric polyurethane. After thermal activation, particulate material 204 is at least partly fused together.

Particulate polymeric material 204 is partly fused together and bonded with fibers 213 on upper surfaces 205 of batt fiber structure 203 and with fibers 114 and 115 inside batt fiber structure 202 such that polymeric material 204 partly impregnates fibers 213, 214, 215 and 216 of batt structure 203 and partly fills interstices between fibers 213, 214, 215 and 216 of batt structure 203 to form porous composite structure 202. In the current embodiment, particulate polymeric material 204 is only applied to batt fiber structure 203 from upper surface 205. As can be seen, polymeric material 204 also partly impregnates yarn 211, 212 of woven base cloth 210.

The porosity of composite structure 202 varies along thickness direction TD. The porosity increases along thickness direction TD from upper batt layer 207 to lower less coarse batt layer 209. Therefore, the porosity of composite structure 202 at a thickness level where composite structure 202 is formed from batt layer 207 with coarse fibers 213, 214 is lower than at a thickness level where composite structure 202 is formed from batt layer 209 with less coarse fibers 215.

In the current embodiment, the paper contacting surface of fabric 201 is provided by upper surface 205 of batt fiber structure 203, which is partly impregnated with polymeric material 204. The paper contacting surface of press fabric 201 has a contact area, for example, of approximately 95%. Press fabric 1 is permeable to water and air and has an air permeability of, for example, approximately 0.1 cfm.

Figure 4:
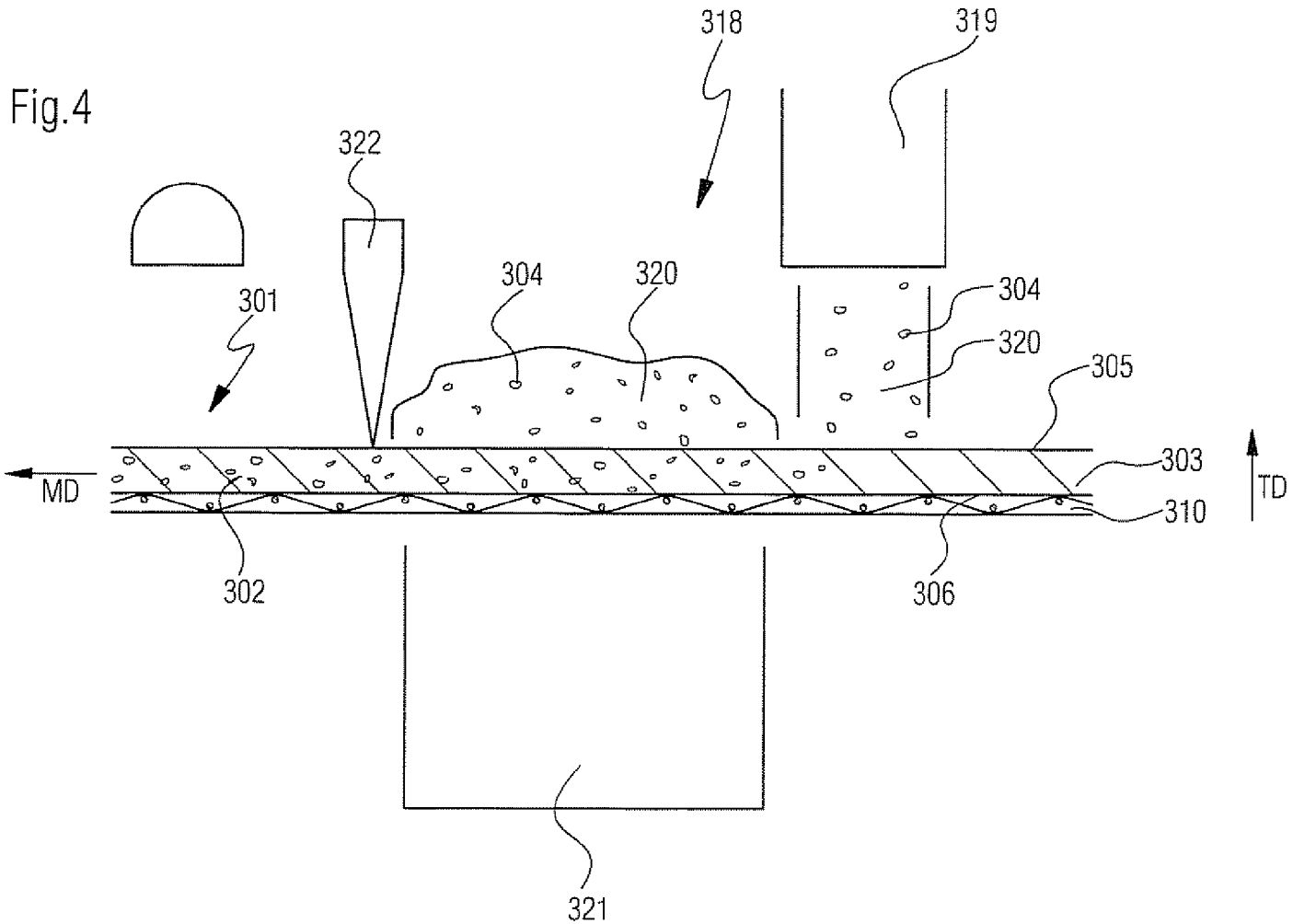
FIG. 4 is a schematic drawing of an embodiment of the method according to the present invention.

Referring now to FIG. 4, there is shown an embodiment of the method according to the present invention. Batt fiber structure 303 with upper 305 and lower surface 306 is provided. Batt fiber structure 303 is needled to base cloth 310. The entire arrangement is moved relative to application means 318 in the direction indicated by the arrow MD. Application means 318 includes, for example, dispenser 319 for applying particulate polymeric material 304 to upper surface 305 of batt fiber structure 303. In the current embodiment, particulate polymeric material 304 is applied to batt structure 303 in the form of dispersion of a particulate polymeric material 320.

According to the present invention, particulate polymeric material 304 is caused to at least partly penetrate into batt fiber structure 303 in a controlled manner along thickness direction TD of batt fiber structure 303 to adjust the amount of polymeric material 303 along thickness direction TD.

In the current case, the controlled penetration of particulate polymeric material 304 is such that the amount of polymeric material 304 in batt fiber structure 303 varies along at least a section of thickness direction TD. The controlled adjustment of the amount of polymeric material along thickness direction TD is achieved by the specific selection of the particle size of polymeric material 304 applied, the sequence of application of small and large particles, the sequence of stacking of coarse and less coarse batt layers relative to each other and the coarseness of the batt layers relative to the particle size.

The penetration of polymeric material 304 into batt structure 303 is influenced by sucking dispersion of particulate polymeric material 320 into batt fiber structure 303 by the application of a vacuum supplied by suction box 321 facing towards lower surface 306 of batt structure 303. Therefore, particulate polymeric material 304 is applied to upper surfaces 305 and the vacuum is applied lower surface 306 of said batt fiber structure 303. After the application of dispersion 320 and before a thermal activation step, dispersion 320 of particulate polymeric material 304 is distributed on upper surface 305 of batt fiber structure 303 with the assistance of doctor blade 322. The particulate polymeric material is thermally activated to form composite structure 302 in which particulate material 304 is partly fused together and bonded to fibers, such that it partly impregnates fibers of the batt structure and partly fills interstices between the fibers of batt structure 303.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An industrial fabric for a papermaking machine, said industrial fabric comprising:

a porous composite structure including:

a batt fiber structure including a coarse batt layer and a less coarse batt layer and having an upper surface and a lower surface extending parallel to said upper surface, said lower surface being spaced apart from said upper surface along a thickness direction extending perpendicular to said upper surface and said lower surface; and a particulate polymer material partly fused together and bonded with fibers of said batt fiber structure, said fibers including fibers inside said batt structure and fibers of at least one of said upper surface and said lower surface of said batt fiber structure, said particulate polymer material at least partly impregnating said fibers of said batt structure and at least partly filling interstices between said fibers of said batt structure to form said porous composite structure, wherein an amount of said particulate polymer material in said batt fiber structure varies along at least a section of said thickness direction of said batt fiber structure, said coarse batt layer including more of said polymeric material than said less coarse batt layer.

2. The industrial fabric according to claim 1, wherein a porosity of said composite structure varies in said thickness direction along said section of said composite structure.

3. The industrial fabric according to claim 2, wherein said batt fiber structure is needled to a base cloth.

4. The industrial fabric according to claim 3, wherein said base cloth is between said upper surface and said lower surface of said batt fiber structure.

5. The industrial fabric according to claim 4, wherein said lower surface of said batt fiber structure adjoins said base cloth.

6. The industrial fabric according to claim 5, wherein a distance between said upper surface and said lower surface of said batt structure defines a total thickness of said batt fiber structure, said amount of said polymeric material decreasing from said upper surface to said lower surface.

7. The industrial fabric according to claim 6, wherein said batt fiber structure includes fibers having a different coarseness.

8. The industrial fabric according to claim 7, wherein said batt fiber structure includes at least two batt layers, each of said at least two batt layers including fibers having one of a predetermined coarseness and a predetermined coarseness range.

9. The industrial fabric according to claim 8, wherein said fibers of one of said at least two batt layers is coarser than said fibers of another of said at least two batt layers, said batt layer having said coarser fibers being a coarse batt layer and said batt layer having less coarse fibers being said less coarse batt layer.

10. The industrial fabric according to claim 9, wherein said fibers of said coarse batt layer are from approximately 17 to 220 dtex.

11. The industrial fabric according to claim 10, wherein said fibers of said coarse batt layer are from approximately 22 to 67 dtex.

12. The industrial fabric according to claim 11, wherein said fibers of said less coarse batt layer are from approximately 1.7 to 11 dtex.

13. The industrial fabric according to claim 1, wherein said coarser batt layer is at a first thickness of said composite structure and said less coarse batt layer is at a second thickness of said composite structure, a porosity of said composite structure at said first thickness being lower than at said second thickness.

14. The industrial fabric according to claim 13, wherein said coarse batt layer is at said upper surface and said less coarse batt layer is at said lower side.

15. The industrial fabric according to claim 14, wherein said upper surface of said batt fiber structure includes said coarse batt layer, said coarse batt layer being partly impregnated with said polymeric material.

16. The industrial fabric according to claim 15, wherein said lower surface of said batt structure includes said less coarse batt layer, said less coarse batt layer being partly impregnated with said polymeric material.

17. The industrial fabric according to claim 16, wherein said upper surface of said batt fiber structure is a paper contacting surface of the fabric, said upper surface being partly impregnated with said polymeric material.

18. The industrial fabric according to claim 17, wherein said lower surface of said batt fiber structure is a machine contacting surface, said lower surface being partly impregnated with said polymeric material.

19. The industrial fabric according to claim 1, wherein said upper surface of said batt fiber structure is a paper contacting surface.

20. The industrial fabric according to claim 19, further comprising a polymer layer extending in a thickness direction over said upper surface of said batt fiber structure, wherein said paper contacting surface is said polymer layer extending over said upper surface.

21. An industrial fabric for a papermaking machine, said industrial fabric comprising:

a porous composite structure including:

a batt fiber structure including at least two batt layers and having an upper surface and a lower surface extending parallel to said upper surface, said lower surface being spaced apart from said upper surface along a thickness direction extending perpendicular to said upper surface and said lower surface; and a particulate polymer material partly fused together and bonded with fibers of said batt fiber structure, said fibers including fibers inside said batt structure and fibers of at least one of said upper surface and said lower surface of said batt fiber structure, said particulate polymer material at least partly impregnating said fibers of said batt structure and at least partly filling interstices between said fibers of said batt structure to form said porous composite structure, wherein an amount of said particulate polymer material in said batt fiber structure varies along at least a section of said thickness direction of said batt fiber structure, wherein a coarseness of said batt layers decreases from said upper surface of said batt fiber structure to said lower surface of said batt fiber structure.

22. The industrial fabric according to claim 21, wherein said paper contacting surface has a contact area of at least approximately 50%.

23. The industrial fabric according to claim 22, wherein said paper contacting surface has a contact area between approximately 80% and 99.5%.

24. The industrial fabric according to claim 23, wherein the fabric is permeable to air and water.

25. The industrial fabric according to claim 24, wherein the fabric has an air permeability between approximately 0.008 cfm to 50 cfm.

26. The industrial fabric according to claim 25, wherein said polymeric material includes a thermoplastic polymeric material.

27. The industrial fabric according to claim 26, wherein said polymeric material is a thermoplastic elastomeric polymeric material.

28. The industrial fabric according to claim 27, wherein said polymeric material is a thermoplastic elastomeric polyurethane.

29. The industrial fabric according to claim 28, wherein the industrial fabric is one of a press fabric and a transfer belt.

* * * * *